US007011581B2

(12) United States Patent
Cole et al.

(10) Patent No.: US 7,011,581 B2
(45) **Date of Patent: *Mar. 14, 2006**

(54) GAMING DEVICE HAVING MAIN GAME ACTIVATING A BONUS EVENT

(76) Inventors: Joseph W. Cole, 10228 Angel Peak Ct., Las Vegas, NV (US) 89134; Elia Rocco Tarantino, 3300 S. Decatur #10-210, Las Vegas, NV (US) 89102

( * ) Notice: Subject to any disclaimer, the term of this patent is extended or adjusted under 35 U.S.C. 154(b) by 270 days.

This patent is subject to a terminal disclaimer.

(21) Appl. No.: 10/316,698

(22) Filed: Dec. 10, 2002

(65) Prior Publication Data

US 2003/0083121 A1 May 1, 2003

Related U.S. Application Data

(63) Continuation-in-part of application No. 09/849,222, filed on May 4, 2001, now Pat. No. 6,533,273, which is a continuation-in-part of application No. 09/653,049, filed on Sep. 1, 2000, now Pat. No. 6,612,575, which is a continuation-in-part of application No. 09/572,711, filed on May 16, 2000, now Pat. No. 6,612,574.

(51) Int. Cl.
*A63F 9/24* (2006.01)

(52) U.S. Cl. ..... 463/16; 463/13; 463/20; 463/12; 273/143 R; 273/138.1

(58) Field of Classification Search ..... 463/16, 463/20, 13
See application file for complete search history.

(56) References Cited

U.S. PATENT DOCUMENTS 3,281,149 A 10/1966 Miller
4,200,291 A 4/1980 Hooker
4,570,934 A 2/1986 Smyth
4,695,053 A 9/1987 Vazquez, Jr. et al.
4,756,531 A 7/1988 DiRe et al.
4,805,907 A 2/1989 Hagiwara
4,836,546 A 6/1989 DiRe et al.
4,871,171 A 10/1989 Rivero
5,067,712 A 11/1991 Georgilas
5,205,555 A 4/1993 Hamano
5,259,616 A 11/1993 Bergmann
5,342,049 A 8/1994 Wichinsky et al.
5,344,145 A 9/1994 Chadwick et al.
5,393,057 A 2/1995 Marnell, II
5,397,125 A 3/1995 Adams
5,722,891 A 3/1998 Inoue (Continued)

*Primary Examiner*—Stephen Blau
*Assistant Examiner*—Dolores R. Collins
(74) *Attorney, Agent, or Firm*—Weide & Miller, Ltd.

(57) ABSTRACT

A game and gaming apparatus include a main game and a bonus game. A player is entitled to participate in the bonus game without an additional wager beyond that required to play the main game. Winning outcomes of the main game determine the indicia used to play the bonus game. In one embodiment upon a winning outcome of the main game, an indicia, such as an image of a winning amount, is transferred to the bonus game. In another embodiment, the bonus event includes categories associated with winning outcomes of the main game, the categories activated based upon wins of the main game. In one embodiment, the main game is a game of video poker. Winning hands are associated with or activate positions of the bonus game. Play of the bonus game comprises selection of at least one of the indicia or positions/categories which have been activated.

15 Claims, 7 Drawing Sheets

U.S. PATENT DOCUMENTS 5,788,573 A 8/1998 Baerlocher et al.
5,823,873 A * 10/1998 Moody ..... 463/13
5,823,874 A 10/1998 Adams
5,848,932 A 12/1998 Adams
5,911,418 A 6/1999 Adams
5,976,016 A 11/1999 Moody et al.
6,033,307 A 3/2000 Vancura
6,059,658 A * 5/2000 Mangano et al. ..... 463/16
6,089,978 A 7/2000 Adams
6,135,884 A 10/2000 Hedrick et al.
6,203,429 B1 * 3/2001 Demar et al. ..... 463/20
6,270,411 B1 * 8/2001 Gura et al. ..... 463/20
6,328,649 B1 * 12/2001 Randall et al. ..... 463/20
6,347,996 B1 * 2/2002 Gilmore et al. ..... 463/17
6,358,144 B1 * 3/2002 Kadlic et al. ..... 463/13
6,364,766 B1 * 4/2002 Anderson et al. ..... 463/16
6,398,219 B1 * 6/2002 Pierce et al. ..... 273/138.2
6,398,644 B1 * 6/2002 Perrie et al. ..... 463/18
6,520,855 B1 * 2/2003 DeMar et al. ..... 463/20
6,616,142 B1 * 9/2003 Adams ..... 273/292
6,645,071 B1 * 11/2003 Perrie et al. ..... 463/16
6,645,074 B1 * 11/2003 Thomas et al. ..... 463/20
6,682,263 B1 * 1/2004 Kennedy et al. ..... 405/132
6,685,561 B1 * 2/2004 Anderson et al. ..... 463/16
6,755,737 B1 * 6/2004 Jackson et al. ..... 463/16
6,769,986 B1 * 8/2004 Vancura ..... 463/30
6,776,711 B1 * 8/2004 Baerlocher ..... 463/16
6,780,109 B1 * 8/2004 Kaminkow ..... 463/20
6,780,111 B1 * 8/2004 Cannon et al. ..... 463/25
6,793,578 B1 * 9/2004 Luccesi et al. ..... 463/20
6,800,026 B1 * 10/2004 Cannon ..... 463/16

* cited by examiner

GAMING DEVICE HAVING MAIN GAME ACTIVATING A BONUS EVENT

RELATED APPLICATION DATA

The present application is a continuation-in-part of U.S. application Ser. No. 09/849,222, filed May 4, 2001, now U.S. Pat. No. 6,533,273, which is a continuation-in-part of U.S. application Ser. No. 09/653,049, filed Sep. 1, 2000, now U.S. Pat. No. 6,612,575, which is a continuation-in-part of U.S. application Ser. No. 09/572,711, filed May 16, 2000, now U.S. Pat. No. 6,612,574.

FIELD OF THE INVENTION

The present invention relates to games and gaming devices arranged to present games for play.

BACKGROUND OF THE INVENTION

Gaming is an industry which has grown immensely in the last few decades. This growth has seen gaming spread from just a few locations to many throughout the world, and has resulted in greater numbers of people than ever participating in gaming. Gaming originally comprised just a few "table" games, such as poker, craps and blackjack. Later, machine based games were offered, such as the now common mechanical reel-type slot machine and the video style slot and poker machine.

One problem facing game manufacturers is the need to continually create new and exciting games to maintain the interest of the public. This is more difficult than it appears at first glance. Of course, to be successful, the new game must appeal to the player to generate a profitable revenue. The gross revenue generated by a game is based on a variety of factors, such the length of time each player plays, the amount wagered, and the average percentage "take" of the game. If the "take" is too high, a player is generally unwilling to play. If the "take" is very low, then it is necessary to ensure that the game is played nearly continuously so that revenue is constantly being derived. When players play a game for only short periods of time, the revenue of the game is generally reduced because of "idle" time between players. The amount wagered also contributes to the revenue. In general, if the amount that a player is willing to bet, either on each game or over time can be increased, then the revenue of the game will generally increase. These and a variety of other factors all contribute to the total revenue produced by a game.

The ability of a game to generate a profit is dependent not only upon the gross revenue produced by the game, but the cost of producing and operating the game device. A game may be very appealing, but if extremely expensive to produce, its revenue may not exceed its costs. Profitability is thus tied to both the cost of the game and the ability of the game to generate revenue.

The appeal of a game and the length of time a player will play a game are dependent upon a number of factors. These factors include some of those described above, such as the odds or take, and on a variety of other factors. For example, a game which is very difficult to understand and play will not tend to draw many long-term players. A few players may take to the game, while most will be alienated and play once or twice. A game which involves little skill may appeal to a wide cross-section of the public because of its ease of play. On the other hand, the length of time a player may play such a game may be fairly short, with the player losing interest unless "luck" is on their side and they see consistent winnings during a session of play.

Thus, it is desirable to produce a game which attracts a wide audience, which keeps the attention of a player for long periods of time, and which causes the player to want to place large wagers.

SUMMARY OF THE INVENTION

The present invention comprises a gaming apparatus and a method of playing a game. More specifically, the invention is a game comprising a main game and an associated bonus event.

One or more embodiments of the invention comprise a gaming apparatus. In one embodiment the gaming apparatus is configured to present a first or main game. A player may be required to place a wager or bet to play the main game. The main game may be a slot-type game presented with a plurality of first or main game reels for displaying indicia. A spin input is provided by which a player is permitted to spin the first reels. A payout mechanism pays the player a winning in the event a predetermined winning combination of indicia are displayed by the plurality of first reels after the spin. The main game may be of a variety of types such as a video game, such as video poker.

In one embodiment, the gaming apparatus is configured to present a second game or bonus event. The bonus event may be presented with at least one additional or bonus reel. The at least one additional reel is adapted to display winning amounts won by the player as a result of playing the bonus game. A spin input is provided by which a player is permitted, at one or more times, to spin the at least one additional bonus reel. The gaming apparatus is arranged to pay the player a winning amount if the result of the spin of the additional, bonus reel comprises a winning outcome. The bonus event may be of a variety of other types, such as a video-presented event.

In one or more embodiments of the invention, one or more of the main game and/or bonus event reels comprise mechanical reels. In other embodiments, one or more of the main game and/or bonus event reels comprise images which are displayed on a video display.

The gaming apparatus is preferably configured to permit the player to engage in the bonus event without having to place an additional wager beyond that required to play the main game. In one embodiment, the player may play the bonus event at any time, although the player is enticed to associate as many winning amounts or indicia with the bonus event as possible from multiple plays of the main game, in order to improve the outcome of the bonus event.

One or more embodiments of the invention comprise a method of playing a game. One such method includes the step of a player placing a wager. The player then engages in a main game, such as by spinning a plurality of first or main game reels having indicia thereon. Next, the outcome of the main game is determined, such as by determining if indicia displayed by the plurality of first reels and associated with a first pay line comprises a predetermined winning combination of indicia. In the event a winning outcome is received while playing the main game, the player is preferably paid a first award. In the event of a winning outcome of a main game, the method includes the step of associating indicia with the bonus event. In one embodiment, this comprises associating the first award with at least one additional or bonus reel. In accordance with the method, at one or more times the player is permitted to participate in the bonus event, such as by spinning the at least one additional reel at one or more times. The outcome of the bonus event is determined and an award provided if the bonus event has a winning outcome, such as by awarding a monetary award associated with the at least one additional reel is associated with a second pay line.

In one or more embodiments of the invention, the step of associating the first award or an indicia with the bonus event, such as a bonus reel, comprises transferring an image of the indicia or the winning value from the first game and displaying that value at the bonus event, such as on the at least one additional reel.

In one embodiment, a player is permitted to continue to associate first awards or indicia with the bonus event until all positions of the bonus event, such as all positions of the bonus reel, are full. Thereafter, the player is permitted to continue playing and may replace indicia, such as lower value first awards with later received higher value first awards.

In one embodiment, a "win all" indicia is associated with the bonus event, such as the bonus reel. A player receiving the "win all" indicia as a result of playing the bonus event, such as spinning the bonus reel, is entitled to a winning comprising the sum of all first awards displayed by or associated with the bonus event/reel.

In accordance with the invention, a game is provided in which a player is entitled to play for a bonus winning amount simply as a result of playing a main game. The player is not required to place an additional bet in order to be entitled to play for the bonus award. Moreover, a player is enticed to play the first game an extended period of time in order to associate indicia or awards with the bonus event, such as a bonus reel, and improve the odds of winning the bonus game.

In one embodiment, a player is permitted to designate a particular indicia as a "win all" indicia. In the event the outcome of the bonus event comprises the designated indicia, the player is entitled to a win all payout. In one embodiment, a player is awarded a progressive bonus award for receiving a particular bonus event outcome.

In other embodiments of the invention, the bonus event has a form other than a reel or wheel. In one such embodiment, the bonus event comprises a bonus board. A player is awarded a bonus amount for receiving particular combinations of indicia on the bonus board, or by removing indicia from the bonus board. In one embodiment, indicia are added to or removed from the board dependent upon winning outcomes of the main game.

In one or more embodiments, a player is permitted to choose the location of an indicia to be associated with the bonus event, such as a location on the bonus board.

In one embodiment, a player is permitted to save a game state, including the status of the bonus event, for later play. In one embodiment, a player is permitted to save indicia upon playing the main game for use in playing the bonus event.

In one embodiment of the game, the bonus event includes a plurality of areas or categories. Each area or category is associated with at least one winning event or outcome which may be received while playing the main game. In the event a winning event or outcome which is associated with one of the bonus event areas or categories is received while playing the main game, those one or more areas or categories are activated in the bonus event. In one embodiment, play of the bonus event comprises the random selection of one of the bonus areas or categories. In one embodiment, the outcome of the bonus event is a winning outcome only if the area or category which is selected has been or is activated.

In one version of this embodiment, the bonus event is a wheel having areas. Each area is assigned an indicia or set of indicia. If a winning outcome corresponding to that indicia or set of indicia is obtained while playing the main game, then that area of the bonus event is activated.

In another version, the main game is a game of video poker in which a player attempts to receive a winning hand. The bonus event has a plurality of areas. In one embodiment, each area is associated with a particular winning hand. If a particular winning hand is received which matches one or more of those areas, then the one or more areas of the bonus event are activated. In another embodiment, bonus areas are blank, and upon receiving a winning outcome or one or more particular winning outcomes while playing the main game, one or more of the areas are activated. In one embodiment, the amount of an award associated with the winning outcome is posted to the bonus event area.

In one embodiment, the game includes a progressive pool. A portion of each wager or bet is assigned to the progressive pool. One of the bonus event categories or possible positions includes the progressive pool. As such, if that position is selected in the play of the bonus event, the player wins an award comprising the progressive pool amount.

Further objects, features, and advantages of the present invention over the prior art will become apparent from the detailed description of the drawings which follows, when considered with the attached figures.

DESCRIPTION OF THE DRAWINGS

FIG. 3(*b*) illustrates indicia displayed by reels of a game being played in accordance with the invention after another spin of the main game reels, wherein a winning combination was received on the main game reels and an associated winning amount from the first game has been transferred to a bonus reel;

FIG. 3(*c*) illustrates indicia displayed by reels of a game being played in accordance with the invention after a later spin of the main game reels, wherein another winning combination was received on the main game reels and an associated winning amount from the first game has been transferred to the bonus reel;

FIG. 3(*d*) illustrates indicia displayed by reels of a game being played in accordance with the invention after a player has spun the bonus reel and received a bonus win;

DETAILED DESCRIPTION OF THE INVENTION

The invention is a method of playing a game and one or more apparatus for presenting a game for play. In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

In general, one aspect of the invention is a game having a secondary event or bonus feature. By a "bonus" feature, it is generally meant that by engaging in a first event or activity, a player is presented at one or more times with an opportunity to engage in an additional, second event or activity. In a preferred embodiment, although the game is considered a single game comprising two parts, both activities of the game primarily comprise events of chance. In one or more embodiments, the bonus event is referred to as a "bonus" event because while the player is required to place a wager to engage in the game, or the first or main activity, the player may participate in the bonus event without placing an additional wager.

One aspect of the invention comprises a game and method of playing/presenting a game wherein by participating in a first event, at one or more times an indicia, value or the like is associated with a second event, which indicia, value or the like is then utilized in the play of the second event. In one embodiment, the first event comprises a main game and the second event comprises a bonus event or game.

Figure 1:
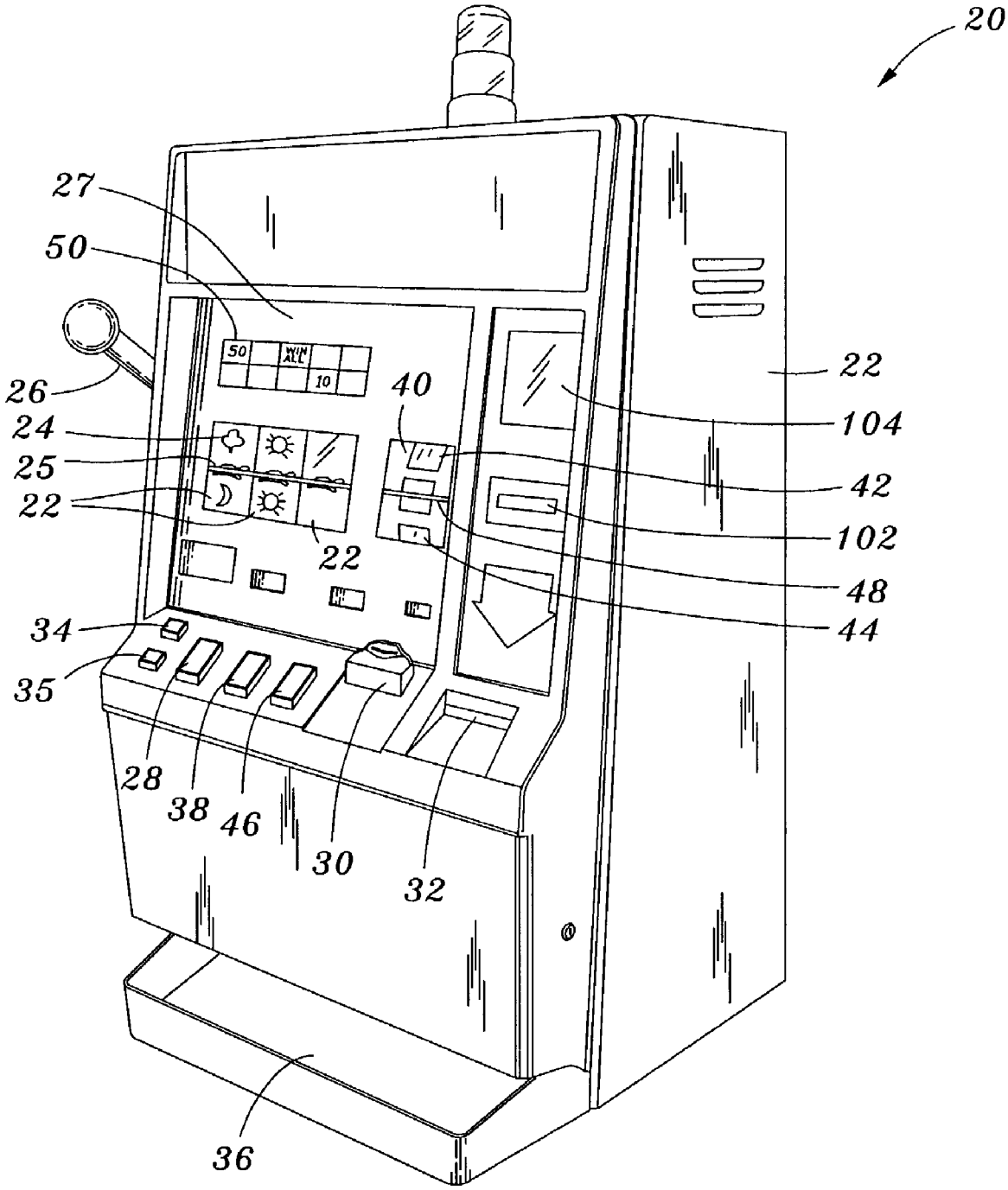
FIG. 1 is illustrates of a gaming apparatus in accordance with an embodiment of the present invention.

FIG. 1 illustrates a gaming apparatus 20 arranged to present such a game in accordance with one embodiment of the invention. The apparatus 20 may have a variety of forms and configurations. As illustrated, the apparatus 20 includes a cabinet 21 for housing and supporting the systems and apparatus necessary to present the game to a player.

The apparatus 20 includes means for displaying game indicia. In one or more embodiments, this means comprises a plurality of mechanical reels 22. In a preferred embodiment, the reels 22 are utilized in playing a first or main game or event, and as such are referred to generally herein as "main game" reels.

Such reels 22 are well known, and comprise a body having one or more indicia or symbols 24 printed thereon. In a preferred embodiment, three reels 22 are provided. In one or more embodiments, each reel 22 includes twelve indicia positions or locations. The indicia 24 displayed on a particular reel 22 may comprise twelve different indicia, or include one or more duplicate indicia. In addition, the indicia 24 displayed on the reels 22 may be the same or different. The indicia 24 may comprise numbers, letters, pictures, symbols or the like.

Preferably, one or more combinations of the indicia 24 when displayed simultaneously as a result of a spin of the reels 22 are designated as a winning combination of indicia. The number of winning combinations may vary dependent upon the desired payout or winning percentage to the players as compared to that which is retained by the game operator. In one or more embodiments, at least one of the same indicia 24 is contained on each of the reels 22, and at least one winning combination comprises all of the reels 22 displaying that same indicia. For example, with reference to FIG. 1, the at least one indicia 24 which is displayed on each reel 22 comprises an image of a turtle. A winning combination comprises all of the reels 22 displaying the turtle image.

Means are provided for rotating the reels 22. In one or more embodiments, the means may comprise a mechanical linkage associated with a spin arm 26, with movement of the spin arm (a "pull") by a user causing the reels 22 to spin. In such an arrangement, the reels 22 are generally allowed to free-wheel and then stop.

In another embodiment, electronically controlled mechanisms are arranged to rotate and stop each reel 22. Such mechanisms are well known to those of skill in the art. In this arrangement, actuation of the spin arm 26 or depression a spin button 28 causes a controller (not shown) to signal the activation of the spin mechanism associated with one or more of the reels 22. Preferably, the controller is arranged to either turn off the signal to the device(s) effecting the rotation of each or all of the reels 22, or generates a signal for activating a braking device, whereby the reels 22 are stopped. As is well known, the combinations of reel positions and their odds of hitting are associated with the controller, and the controller is arranged to stop the reels 22 in a position displaying a combination of indicia as determined by the controller based on the combinations and odds. The principal of such an arrangement is described in U.S. Pat. No. 4,448,419 to Telnaes, which is incorporated herein by reference.

In a preferred embodiment, each reel 22 is positioned behind a screening glass or panel 27. The panel 27 includes at least one area through which each of the reels 22, and thus the indicia 24 thereon, may be viewed. In order to aid the player in determining which indicia 24 displayed by the reels 22 comprises the indicia which are evaluated for determining if a winning combination has been received, a pay line 25 is provided. The pay line 25 comprises a line or bar which extends over the reels 22. As illustrated, the pay line 25 comprises a line printed on the screening glass aligned over a central portion of each reel 22. When the reels 22 stop rotating, the indicia 24 on each reel 22 which the pay line 25 extends over or intersects comprise the indicia 24 which are evaluated for determining if a winning combination has been received. Of course, the pay line may be imaginary, and a winning combination determined by the controller or the position of the reels.

The gaming apparatus 20 includes a mechanism for accepting a wager. As illustrated, a coin accepting mechanism 30 is provided for accepting coins. A bill acceptor 32 is provided for accepting bills. Other mechanisms may be provided for accepting a wager, such as card or ticket readers or input devices whereby a player may have funds paid from a remote account. A "play credit" 34 button and a "bet max" button 35 may also be provided for permitting a player to place wagers from a pool of credits won or paid by the player. The gaming apparatus 20 may be adapted to accept a variety of coins, such as dimes, quarters or silver dollars. In one or more embodiments, playing a single credit comprises playing an amount of one of the accepted coins, and playing a maximum bet comprises playing or betting an amount comprising a multiple of the value of a single of the accepted coins.

The gaming apparatus 20 includes a means for paying a player winnings. When a player wins a game, the player is preferably paid in the form of stored credits, the amount of which is indicated to the player. A "cash out" button 38 is preferably provided for permitting a player to be paid the winnings or any paid in credits. In one embodiment, the means for paying a player comprises a coin dispenser (not shown) for dispensing coins to a coin tray 36. A player may also be permitted to be paid their credits or winnings on a player card (as described below) in electronic form.

As described above, the gaming apparatus 20 preferably includes a controller (not shown) for controlling the game, including receiving player input and sending output signals for controlling the various components of the apparatus 20. The controller may be arranged to receive input in the form of a "spin" signal from a spin button or the spin arm 26 (or other spin input), a bet credit signal when the bet credit button 34 is depressed, and a credits insert signal when a player inserts bills or coins. The controller may be arranged to send signals for stopping the reels 22, for causing the coin dispenser to pay winnings, and cause a display to display winning amount information. In addition, the controller is preferably arranged to determine if a spin of the main game reels 22 has resulted in a win, and if so, the amount to be payed to the player for that win.

The number of winning combinations, the odds of receiving a winning combination and the payout for each winning combination may vary, as is well known in the art. If the reels are purely mechanical, the odds of winning are based on the number of indicia, the number of reels, and the number of predetermined winning combinations. As described above, when a mechanism is employed for stopping the reels 22 in predetermined positions, the controller may be programmed to present desired odds. It will also be appreciated that a player may be paid more for a winning combination when the player places a larger wager. In this regard, the player may be presented with a pay table which indicates the payout for each winning combination based on the wager placed by the player.

The controller may comprise one or more than one element, and may comprise hardware and/or software, such as code executable by a processor. The code may be stored on an appropriate data storage device, such as a hard drive or memory chip, or be integrated into a micro-processor chip. The controller may be part of an integrated system, or be self-contained. The arrangements of such a controller and the principles of odds, payouts and the like are well known to those of skill in the art.

In accordance with an embodiment of the invention, the gaming apparatus 20 is arranged to present a player with an additional or bonus game or event associated with the first event or main game described above. In one or more embodiments, a player is permitted to participate in the bonus event or game at any time, without regard to the outcome of the first game or event. In one embodiment, however, the outcome of the first game or event changes a state of the bonus event, such as indicia used to play the bonus event or a payout associated therewith. In one or more other embodiments, the player is presented with the opportunity to participate in a bonus or additional event upon the occurrence of one or more events related to the main game, without being required to place an additional wager, and with the opportunity to win an additional payout separate from any payout awarded by playing the main game. As described below, this second event is referred to as a bonus or additional feature. The event is referred to as a "bonus" event because the player is at one or more times, simply by having played the first or main game or having placed an main bet, provided the opportunity to win bonus event winnings or additional winnings without being required to place an additional bet.

In one or more embodiments, the bonus event is presented using one or more bonus, additional or second reels. Preferably, the one or more additional reels comprise a single, fourth, bonus reel 40. The bonus reel 40 is arranged to display indicia associated with a bonus feature of a game played on the apparatus 20. In a preferred embodiment, the bonus reel 40 is capable of displaying twelve of the same or different indicia 42, and thus has twelve positions or locations.

In a preferred embodiment, the bonus reel 40 is capable of displaying indicia 42 comprising winning amounts or payouts received by a player when playing the first or main game using the main game reels 22. In one or more embodiments, such indicia 42 comprise numeric payout amounts, such as paid credit or winning values. These values are dependent upon the winnings paid in accordance with the play of the main game reels 22. One of the indicia 42 preferably comprises a "win all" indicia 44. In other words, in a preferred embodiment, the bonus reel 40 is capable of displaying twelve (12) indicia 42 including the "win all" indicia 44, i.e. eleven (11) indicia plus the "win all" indicia, and thus includes eleven (11) locations for indicia comprising amounts paid the player for receiving winning combinations when playing the main game. In one or more other embodiments, the "win all" indicia 44 is not included, or other indicia are included which are associated with the bonus reel 40 but not with the main game.

In accordance with an embodiment of the apparatus 20, the player is permitted to, at one or more times, spin the bonus reel 40 or otherwise initiate or play the bonus event. Preferably, a separate bonus reel "spin" button 46 or other spin input is provided for this purpose. When the bonus reel spin button 46 is activated and is depressed, the bonus reel 40 is caused to spin and then stop, displaying either a blank or unfilled position, or one of the indicia 42 thereon. Preferably, as with the main game reels 22, a pay line 48 is provided for indicating whether an indicia displayed by the bonus reel 40 is a winning indicia. As stated below, the player may be permitted to participate in the bonus event, such as by spinning the bonus reel 40, at any time at least an ante or bet is placed. In one or more other embodiments, the player may be permitted to participate in the bonus event only after one or more values have been associated with the bonus reel 40 or other bonus event as a result of one or more outcomes of the main game.

Means are provided for causing the bonus reel 40 to display winnings paid as a result of play of the main game. In one embodiment, the bonus reel 40 comprises a mechanical reel which is arranged to rotate. Display means are associated with the bonus reel 40 for displaying the indicia 42. In one or more embodiments, LEDs are associated with the bonus reel 40 for displaying the indicia 42. In other embodiments, one or more lasers may be arranged to display images on the reel 40, or the reel 40 may include one or more LCDs or other display devices. Such display devices are arranged so that the bonus reel 40 may still rotate, but the indicia associated therewith may be changed to reflect winning values from the main game, which values may change over time.

In accordance with the invention, LEDs may be arranged to project indicia images onto the bonus reel 40 from behind. A control is provided for selectively activating the LEDs to generate differing images. In one or more embodiments, as described below, the indicia 42 may comprise credit values such as the numbers 10, 20 or the like, and the LEDs may then be arranged to project images of such values. In another embodiment, the reel 40, wheel or other feature may be illustrated with a hologram or similar projected element.

The bonus reel 40 need not actually display each and every indicia 42 which is associated with it. For example, in an embodiment where the bonus reel 40 is mechanical, only the reel locations facing the player and which are visible need to be capable of displaying indicia. In this arrangement, a large number of indicia 42 may be associated with the bonus reel 40, but only a few of these indicia may be displayed at any given time. Of course, the same is true in that instance where, as described below, the bonus reel 40 comprises a computer generated image.

Those of skill in the art will appreciate that the main game reels 22 and/or the bonus reel 40 may instead comprise one or more electronic displays for displaying information such as the indicia 24,42. For example, in one or more embodiments, an LCD screen may be arranged to display an image comprising the main game reels 22 and the indicia 24 associated therewith, and the bonus reel 40 and the indicia 42 associated therewith.

In a preferred embodiment of the invention, the main game reels 22 comprise rotating mechanical elements, and the bonus reel 40 comprises an electronically displayed image. In such event, the controller for causing the different indicia 42 to be display on the bonus reel 40 comprises a video controller causing the different images to be displayed by the video screen. The video controller may be arranged to cause the image of a "rotating" mechanical reel to be displayed to simulate rotation of a physical reel.

As described above, a variety of the player input devices or controls comprise physical electromechanical buttons. In place of, or in addition to such controls, one or more touch-screen or touch-sensitive displays may be provided. Such screen(s) may be arranged to display information to a player and accept input from the player. For example, the screen may display a "spin" button area which when touched by the player serves to provide a "spin" signal to the controller.

In a preferred embodiment of the invention, the main game reels 22 comprise mechanical reels which are activated by either the spin arm 26 or a spin button comprising a touch screen button. The bonus reel 40 comprises a video simulated reel which is activated by a touch screen button as well.

In one or more embodiments of the invention, there may be fewer than three or greater than three main or first reels 22. As described in more detail below, the main game may be other than a "reel" or slot type game, such as a video poker game. Further, as described above, the number of indicia associated with the reels 22 may vary. There may be more than one additional second or bonus reel 40 as well, and as described below, the form of the bonus event may vary. For example, two bonus reels may be provided, and winning amounts from the first game may be associated with one or both of the bonus reels. The player may then only receive a bonus winning if the resultant spin of both bonus reels comprises a winning combination. In another embodiment, one of the bonus reels may display other indicia, such as multipliers. Upon a spin of the bonus reels, a player may receive a winning amount based on the outcome of a first of the bonus reels, which amount may be increased by a multiplier depending on the outcome of the spin of the bonus of the bonus reels. There are a wide variety of combinations of such additional reels. In one embodiment, a player may be permitted to spin one of the bonus reels without paying an additional wager, but may be required to place an additional wager in order to spin a multiplier bonus reel or the like.

In one embodiment, indicia may be posted or associated with a plurality of bonus wheels or other bonus events, and the play of the bonus event may comprise engaging in a plurality of activities. For example, in one embodiment, there may be three bonus wheels to or with which indicia are associated from play of the main game. Play of the event game may comprise spinning each of the three bonus reels (whether at the same time or sequentially), where the outcome of the bonus event is dependent upon the outcome of the spin of all of the bonus reels or wheels. In one embodiment, the player may win the bonus event only if the player receives three of the same bonus indicia. In another embodiment, the player may win the sum of the values of the three indicia. It will be appreciated that a variety of arrangements of a bonus game or event may be provided in accordance with this aspect of the invention. In one embodiment, a player may attempt to receive a particular combination of bonus indicia to win the bonus event. For example, a player may be declared a winner of the bonus event by receiving either sequentially (such as on successive spins of a single bonus reel) or simultaneously (such as on a pair of side-by-side bonus reels) the same indicia. In one embodiment, the player may attempt to receive a combination of indicia which forms a larger image or indicia. For example, a player may be awarded a car upon receiving an indicia of the front half of a car and a rear half of a car on side-by-side bonus reels.

In one or more embodiments of the invention, the main game may comprise other than a "slot"-type game as described above. For example, the first or main game may comprise video poker or a game in which the player plays the house, such as "21." When the player wins the game, as determined by the criteria for that game, then the player is paid a winning amount. This amount or an indicia used in the main game or representative of an outcome of the main game is then associated with the second or bonus event, as described above.

In one or more embodiments, the amounts which are associated with the bonus game need not comprise the actual winning amount(s) from the main game. For example, the amounts associated with the bonus game may comprise a fraction of the winning amount from the main game, such as ½, or may comprise a multiple of the winning amount from the main game, such a 2×, 5×, 10× or the like. In one or more other embodiments, for each win of the main game, an amount may be randomly selected for association with the bonus game. For example, one winning amount from the group comprising 5 credits, 10 credits and 20 credits may be assigned to the bonus event when a player wins the main game. As also described herein, the indicia associated with the bonus event need not comprise values at all, but may comprise any of a variety of elements, such as images of prizes.

In one or more embodiments, the amounts which are associated with the bonus event need not be displayed immediately to the player. For example, in one embodiment, when a player receives a winning combination on the main game reels 22, the winning indicia may be displayed on the bonus reel 40 without value amounts. In one embodiment, only the indicia 42 are displayed on the bonus reel 24, with no bonus amounts. In one embodiment, the indicia 42 may "explode" or otherwise be transformed to display the amount associated with the bonus reel 40 shortly after being associated with the reel 40. In another embodiment, amounts associated with an indicia 42 are only displayed after a spin of the bonus reel 40.

As stated above, in one embodiment, the "win all" amount may comprise the sum of all amounts associated with every indicia 42 associated with the bonus reel 40. In one or more embodiments, the amount paid to a player for hitting the "win all" indicia 44 on the bonus reel 40 may comprise a jackpot award. In a preferred embodiment, the jackpot award may comprise a progressive award. For example, a percentage of the amounts wagered by players playing the device 20 may be set aside into a progressive pot. This pot grows until a player hits the "win all" indicia 44 on the bonus reel 40, at which point the amount associated with the progressive pot is awarded to the player. As will be appreciated, the progressive award may be much larger than the sums of all of the amounts associated with the other indicia 42 associated with the bonus reel 40. In one embodiment, a plurality of the devices 20 may be linked to one another to provide a multi-device progressive, where the pot comprises the aggregate of the reserved sums from all of the devices 20. In this manner, the progressive award may be larger than could be achieved by a single of the devices.

In one embodiment, a player is awarded the aggregate amounts associated with the indicia 42 when the player receives a win all on the bonus reel 40, unless a progressive amount is larger than that aggregate amount. In the event the progressive amount is larger than the aggregate amount, then the player may be awarded the progressive amount. In this manner, a player is enticed to play regardless of the present value of the progressive amount. If the progressive has just been awarded and is low, then the player attempts to associate large amounts with the bonus reel 40 to win a large aggregate award. If the progressive amount is larger, then the player is enticed to play for the progressive. In one embodiment, the progressive amount may be pre-set to never fall below a predetermined amount.

In one or more embodiments, the winnings paid to a player may comprise other than money. For example, a player may win gifts, such as goods or services. In that event, words or symbols identifying the win may be associated with the bonus reel 40. The gaming apparatus 20 may be arranged to print a ticket by which the player redeems their winnings instead of dispensing the winnings directly.

Figure 4:
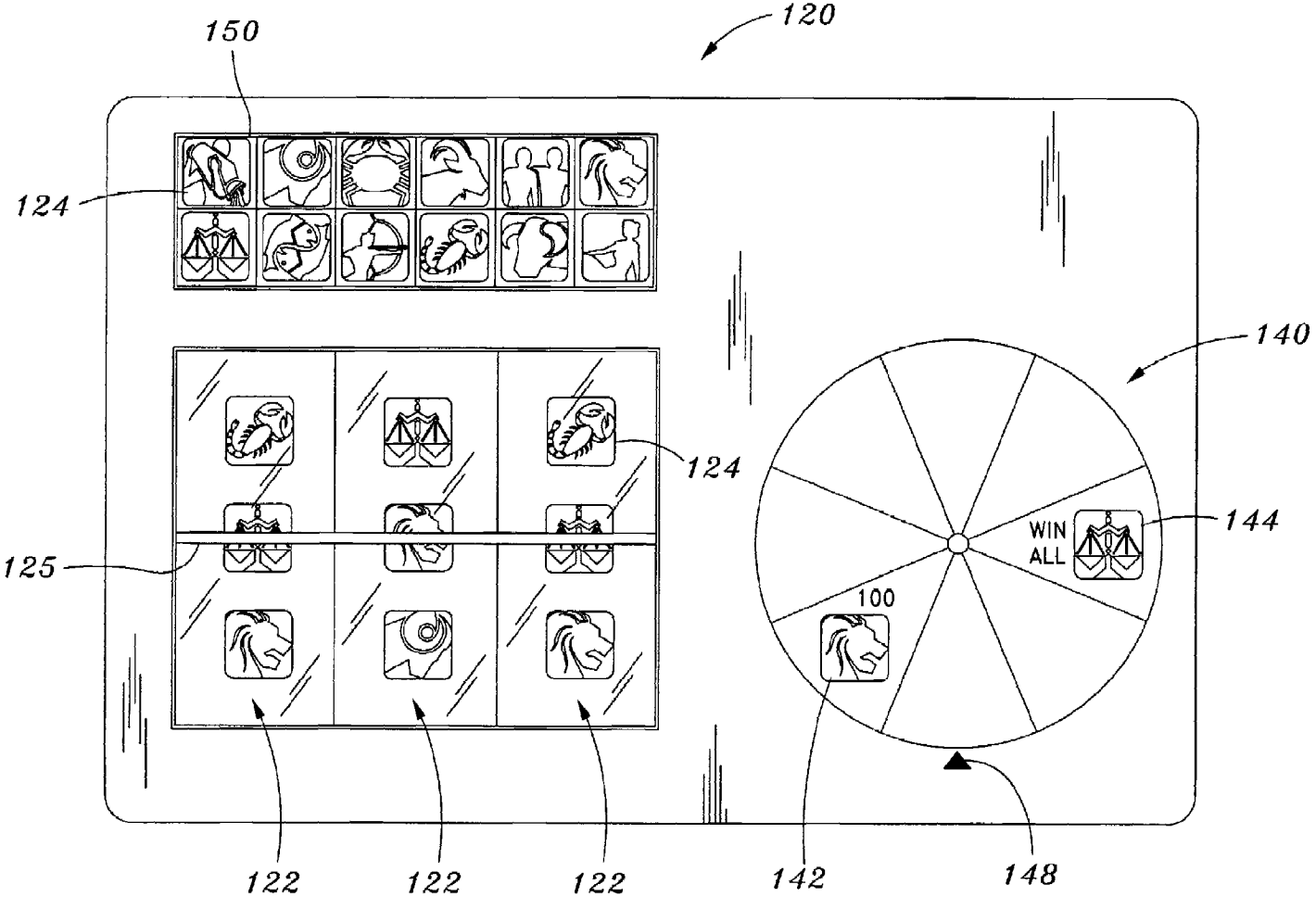
FIG. 4 illustrates a gaming device in accordance with another embodiment of the invention.

The bonus event or game need not have the exact format as described above. For example, in one or more embodiments, as illustrated in FIG. 4 and described below, the bonus event may comprise a Roulette-wheel type game in which the numbers associated with the wheel comprise winning amounts associated with the wheel when won playing the main game.

In accordance with one or more embodiments of the invention, the gaming apparatus 20 may be linked to a central computer or comprise a part of a system. In one embodiment, a plurality of the gaming apparatus 20 are associated with a gaming system. The system may include one or more central computers which receive data from the apparatus 20 and which send data to each apparatus 20.

In one or more embodiments of the invention, the gaming apparatus 20 may be provided with a player card 100. The card 100 may have a variety of features. In one or more embodiments, the card 100 may comprise a player tracking card as is known in the art. In this regard, the card 100 may be used to store player identification information or an identification code associated with player information stored elsewhere. For example, a gaming establishment may reward players for their play and continued play over time. When the player begins playing a game in accordance with the invention, the player may insert their card 100 into a card reader 102 or similar device associated with the gaming apparatus 102. The information associated with the card 100 is transferred to the gamine system for use by the gaming establishment. In addition, the information may be transferred to the card 100 and stored thereon. The gaming establishment may provide awards, such as food or money, to reward a player for their play. The awards may be based upon a number of points generated by a player associated with their play, such as the length of time of play. The gaming establishment may update the points awarded to a player at the end of each gaming session in which the player participates.

In a preferred embodiment of the invention, the card 100 has information associated therewith which causes the gaming apparatus 20 to specially configure itself for a particular player. In one or more embodiments, the card 100 has information associated therewith which comprises a language code which is utilized by the gaming apparatus 20 to specifically configure the game presented. In a preferred embodiment, the language code is utilized to cause the gaming machine 20 to display information in a particular language.

In one or more embodiments, a number of language codes are provided, each code associated with a particular language, such as English, Spanish, German or the like. When the code is read by the gaming apparatus 20, the apparatus 20 is arranged to display certain information in the particular language associated with the code. The information which is displayed in the language may vary. In one embodiment, the gaming apparatus 20 includes a display 104 which displays instructions, game status and other information to the player. The information which is displayed by this display 104 may be displayed in the particular language associated with the code.

Of course, other information may also be displayed in accordance with the particular code. For example, a changeable display may be associated with one or more of the buttons such as the bet credit button 34 or the bet max button 35, the information displayed on which is changed dependent upon the code. The indicia which are displayed by the reels may also be changed.

In one or more embodiments, the card 100 comprises substrate of plastic or similar material having a magnetic stripe for storing information. Of course, a variety of media may be used to store the information. The card 100 may have information printed, encoded or otherwise associated therewith. In addition, it is not necessary that a card be used. An encoded chip, or a token, paper slip, pass, or other media may be used.

In one or more other embodiments, a particular language code is not associated directly with the media, such as the card 100, but is instead stored at the gaming apparatus 20 or a computer or similar device which the apparatus 20 is in communication with. For example, a player identifier may be stored on the card 100, and a data file may be stored on a central computer which corresponds to that player identifier. That data file may contain a particular language code. When the player inserts their card, the gaming device 20 may utilize the player identification information to access the language code for that player from the database. In this arrangement, the means by which a player identifies themselves need not comprise an independent media, but may comprise a biometric identifier. Such may comprise fingerprints, retinal images or the like.

In one or more embodiments, the gaming apparatus 20 is adapted to specially configure itself in other than, or in addition to, just changing the language of displayed information. For example, the gaming apparatus 20 may be adapted to accept foreign money and provide monetary conversion information to the player.

As described above, the gaming apparatus 20 includes a card acceptor 102. The card acceptor 102 comprises a card reader for reading information from the card. The particular means for reading the information may vary dependent upon the manner by which the information is associated with the card. For example, a magnetic stripe reader is used to read information from a magnetic stripe. An optical reader may be used to read printed information. Retinal and fingerprint scanners are used to image retinas and fingerprints. In one or more embodiments, the gaming apparatus 20 may include more than one type of reading device.

Play of a game in accordance with the present invention will now be described. In one or more embodiments, the game is presented for play on an apparatus 20 such as that illustrated in FIG. 1, and reference is made herein to such an apparatus. Of course, a game played in accordance with the invention may be presented on a wide variety of gaming devices other than that specifically illustrated and described herein.

Figure 2:
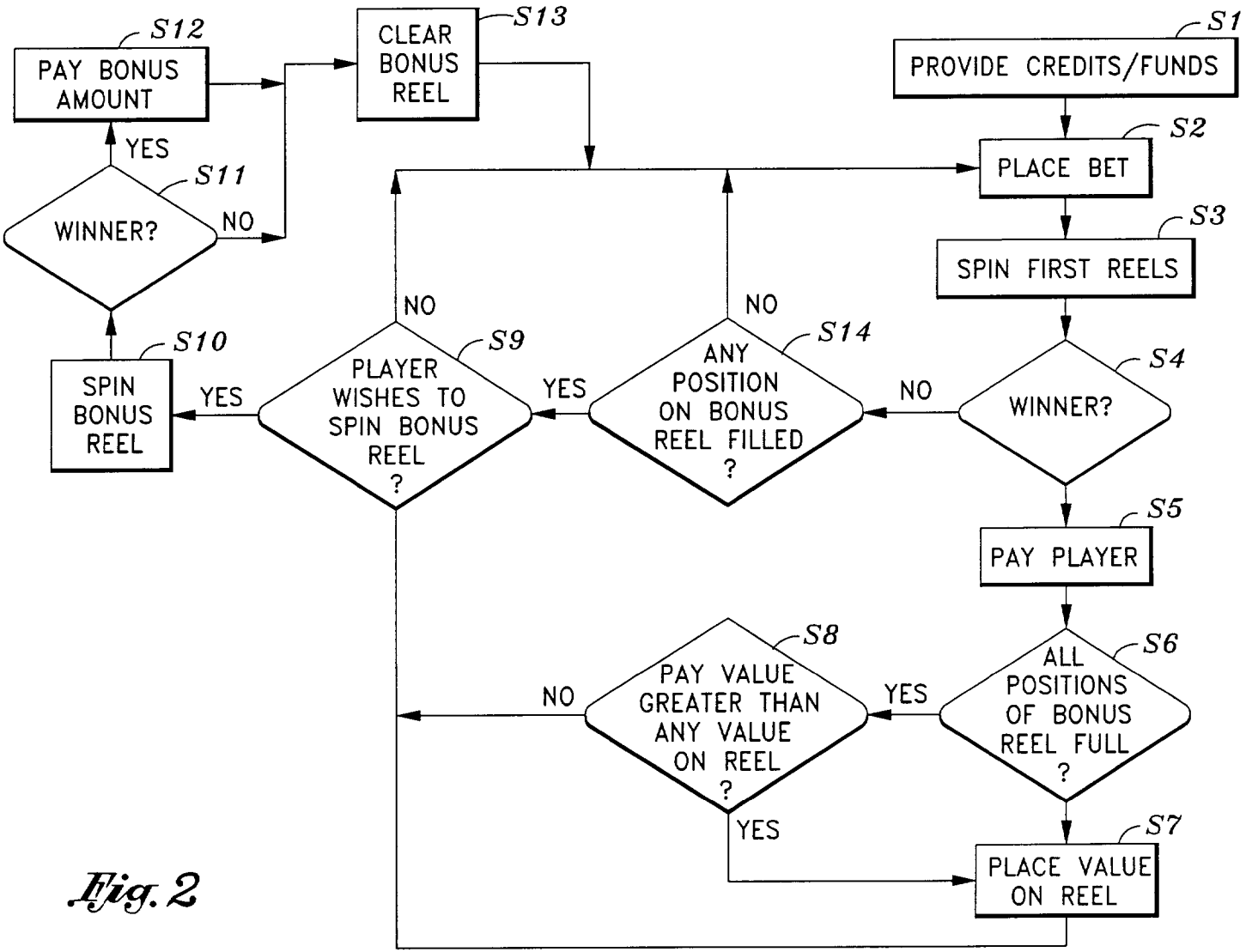
FIG. 2 is a flow diagram illustrating a method of playing a game in accordance with an embodiment of the present invention.
Figure 3A:
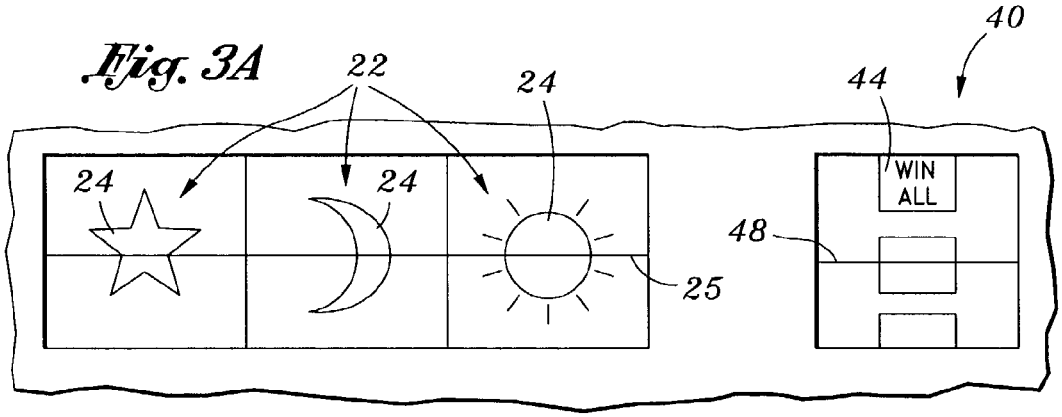
FIG. 3(*a*) illustrates indicia displayed by reels of a game being played in accordance with the invention after a first spin of the main game reels.
Figure 3B:
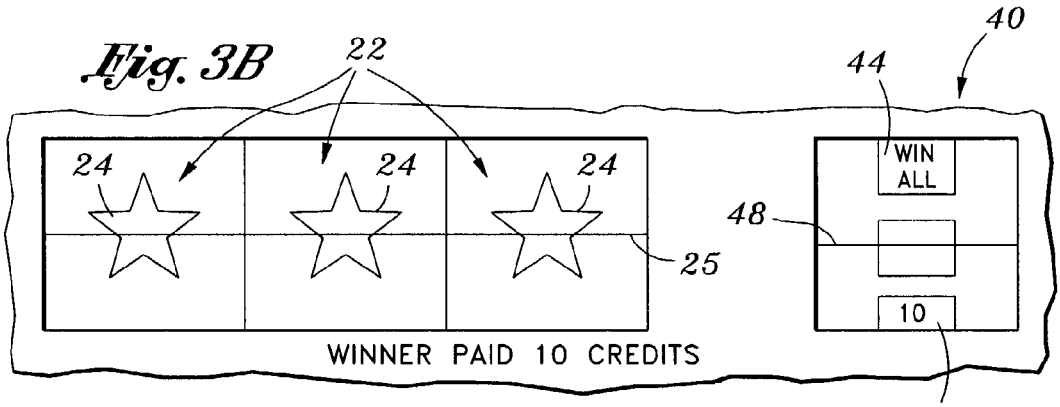
Figure 3C:
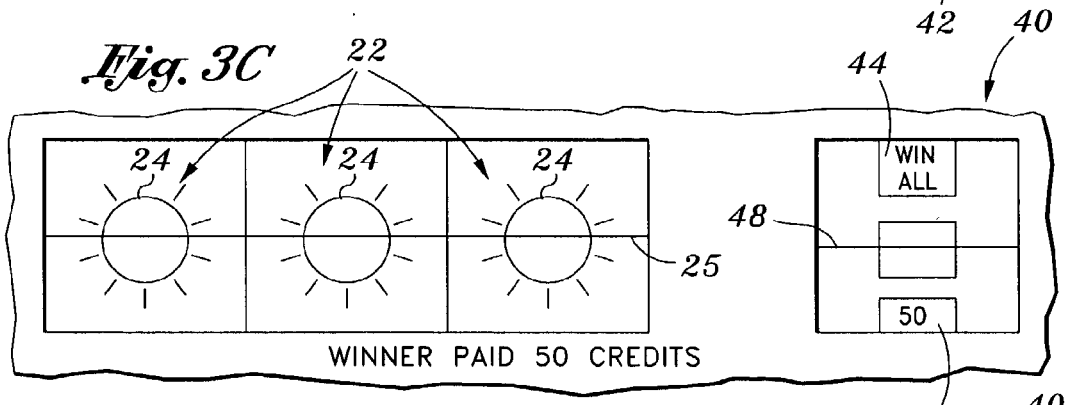
Figure 3D:
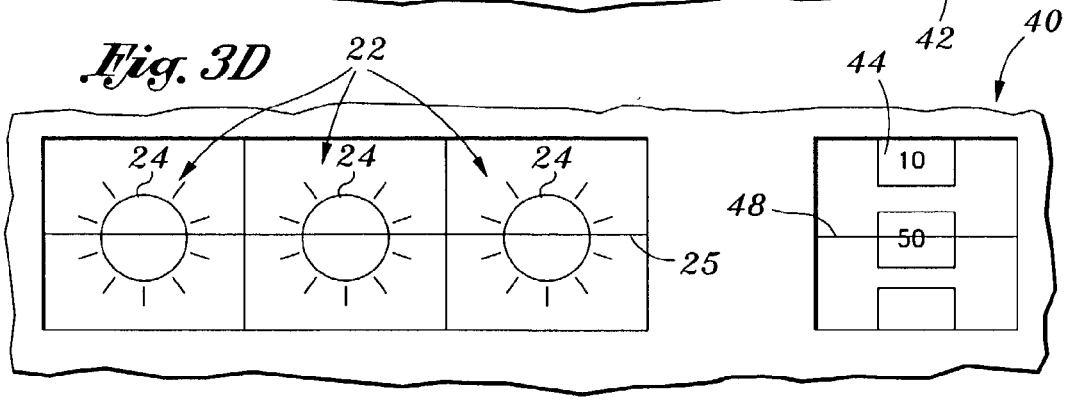

Referring to FIG. 2, in a preferred embodiment of the invention, in a first step S1, a player provides monetary input, such as by inserting coins to the coin acceptor 30, bills to the bill acceptor 32, or the like. Next, in a step S2, the player places a wager or bet. In one or more embodiments, this may be accomplished by the player depressing one or more times the bet credit button 34, or pressing the bet max button 35.

In a step S3, the player is permitted to spin the main game reels 22. In one embodiment, when the player depresses the "spin" button 28 or pulls the spin arm 26, the reels 22 are caused to spin, as described above. The reels 22 then stop (or are caused to stop), with each reel displaying an indicia 22 associated with the pay line 25. It is noted that the term "spin" as used herein is not limited to actual rotation of the reels. For example, a "spin" may result when a controller is caused to display a reel and indicia associated therewith on a display. In general, the term "spin" simply means a triggering event for causing the indicia to be randomly presented.

In a step S4, it is determined if the main game reels 22 display a winning combination of indicia 22. As described above, such comprises comparing the indicia 22 which are associated with the pay line 25 with predetermined winning combinations of indicia.

If the player has received a winning combination, then in a step S5, the player is paid the winnings. The payout may be paid in coins, such as through the coin tray 36, or as credits which the player may then bet using the bet credits and bet max buttons 34,35 or which the player may elect to have paid by pressing the cash out button 38.

In a step S6, it is determined if all of the positions associated with the bonus reel 40 for displaying indicia 42 are full. If not, then in a step S7, the amount won or paid to the player for receiving a winning combination on the main game reels 22 is associated with the bonus reel 40. As described above, there are a variety of means by which such indicia may be displayed by the reel 40. In one or more embodiments, in this step the bonus reel 40 is rotated to a position in which it displays a location not yet occupied by an indicia 42, and then the new indicia 42 is displayed thereon. In this manner, the player is permitted to view the addition of the newest winning amount to the bonus reel 40. As described above, the displaying of the indicia 42 may be associated with a mechanical reel or simply a video display of a reel.

If in step S6 all of the positions for indicia 42 associated with the bonus reel 40 are full, then it is determined in a step S8 if the amount won or paid to the player is greater than any of the values already associated with the bonus reel 40. For example, if the player just won 50 credits and one of the indicia 42 associated with the bonus reel 40 was 25 credits, then the answer to this inquiry would be yes. If the new amount exceeds any amount currently associated with the bonus reel 40, then in step S7, the new amount is added to the reel 40. More particularly, the new amount is used to replace any one indicia 42 associated with the bonus reel 40 which is less than the new amount. Again, the reel 40 may be rotated to the position of the indicia 42 which is to be replaced, and then be replaced in a manner permitting the player to view the replacement.

In a preferred embodiment, the player may be permitted to select the position on the bonus reel 40 which the player would like to associated an award with. For example, the player may be permitted, after winning the main game, to rotate the bonus reel 40 with a selector to any one of the positions which are unfilled on the bonus reel 40. The player may then press an "enter" or similar button or provide other input which causes the award value from the main game to be associated with that particular position on the bonus reel 40. While such does not allow the player to change the real odds of the bonus event, it permits the player to have more perceived control over the bonus event.

In a preferred embodiment, a bonus display 50 is provided which is capable of displaying each of the positions of the bonus reel 40. The bonus display 50 displays a duplicate of each position of the bonus reel 40 and any indicia associated with those positions. In this manner, a player can readily identify how many of the positions of the bonus reel 40 are filled, and with what award values. This display 50 may be of a variety of types, such as an LCD display.

In one embodiment, the display 50 may be integrated into and comprise a portion of the bonus reel 40. For example, in an arrangement where the bonus reel 40 is presented by a video display, when the bonus reel 40 is not being spun, each of the positions of the reel 40 may be displayed in similar fashion to that of display 50. In one embodiment, the positions are all illustrated in a vertical column. Of course, any indicia associated with a position is also illustrated. When the player wishes to spin the bonus reel 40, the column of displayed positions are transformed (by video transformation) into a displayed spinning reel. In this fashion, the player sees all of the positions of the reel and associated indicia during play of the main game, but when play of the bonus event occurs, the player views a reel.

In step S8 if the new winning amount is not greater than any current amount associated with the bonus reel 40, then the amounts associated with the reel are not changed. Information to this effect may be displayed to the player, such as "Bonus Reel Full of Higher Amounts. Do you Wish to Spin?" In such event, or after an indicia 42 is associated with the bonus reel 40 in step S7, it is determined in a step S9 if the player wishes to spin the bonus reel 40. In the arrangement of the apparatus 20 illustrated in FIG. 1, such may be indicated by the player pressing the spin bonus reel button 46.

If the player does not wish to spin the bonus reel 40, then the game sequence returns to step S2, with the player being required to place a bet to continue the game. If the player wishes to spin the bonus reel 40, then in a step S10, the bonus reel 40 spins.

In a step S11, it is then determined if the player has received a winning event based on the spin of the bonus reel 40. In a preferred embodiment, the player is declared the winner if the player receives any indicia 42, including the "win all" indicia 44. As described above, a winning indicia may be indicated when an indicia 42 is aligned with the pay line 48. Of course, the bonus reel 40 may stop at a location associated with the pay line 48 which is not occupied or filled with an indicia 42. In such event, the player is not a winner of the bonus game.

In a step S12, if the player wins the bonus game, then the player is paid the winnings. In one or more embodiments, the winnings comprise the amount associated with the bonus reel 40 which was aligned with the pay line 48. As described above, these amounts preferably comprise previous winning amounts from the main game. In addition, the player may win the "win all" amount, in which case the player is paid the total of all of the indicia 42 associated with the bonus reel 40. In this step, the player may be paid the winnings in coins, credits or by other means known in the art.

Whether or not the player won or lost the bonus game, in a step S13, the indicia 42 associated with the reel 40 are removed (i.e. disassociated) therefrom. In a preferred embodiment, the "win all" indicia 44 is retained on the reel 40 at all times, however, since without any other indicia associated with the bonus reel 40, the "win all" would comprise no win.

Referring again now to step S4, if the player was not a winner of the main game, then in a step S14 it is determined if any of the locations on the bonus reel 40 are filled with indicia 42 other than the "win all" indicia 44. In other words, it is determined if the present or a previous player at some point won the main game. If not, then the player is prompted to bet one or more credits to play the main game in order to continue, returning to step S2. If so, then the player is entitled to try and win the bonus game by spinning the bonus reel 40 in step S9. In such event, play continues as described above.

In another preferred embodiment of the invention, a player is permitted to spin the bonus reel 40 at any time. In other words, the game and method are arranged so that the player may participate in the bonus event or spin the bonus reel 40 regardless of the outcome of the main game. In a preferred embodiment, however, bonus win values are not associated with the bonus event or bonus reel 40 unless a particular outcome is achieved as a result of playing the main game. Thus, in one embodiment, when a player first plays the game the bonus reel 40 may have no values associated with it. Nonetheless, the player is permitted spin the bonus reel 40. In another embodiment, one or more values may be pre-associated with the bonus reel 40 and once the player has placed a bet, the player may immediately spin the bonus reel 40. In such event, the method of play is modified from that illustrated in FIG. 1 to include a step S1.5 between step S1 and S2 linking to step S9 where it is determined if the player wishes to spin the bonus reel, and wherein step S14 is at least optionally omitted, permitting the player to spin the bonus reel 40 after a spin of the first reels, regardless of whether the bonus reel has any positions filled.

An example of the play of a game in accordance with the above-method will now be described with reference to FIGS. 3(*a*)–(*d*). First, a player inserts money for playing the game. In one embodiment, the player is then permitted to either spin the bonus reel or the main game reels. If the bonus reel is empty, it is presumed that the player will likely elect to spin the main game reels 22. Presume that the player receives the combination of indicia comprising the symbols of a star, moon, and sun (see FIG. 3(*a*)) and this is a non-winning combination. The player is declared a loser and it is next determined if the player is entitled to play the bonus game. In one embodiment, the player is automatically entitled to play the bonus game. In another embodiment, since the player has not yet won the main game, unless one or more indicia 42 are associated with the bonus reel 40 from a prior game to played by another player, then the player is not permitted to play the bonus game. Presuming that one or more indicia/values are associated with the bonus reel 40 (for example, if the previous player of the apparatus spun the bonus reel on their last play, then all of the indicia would have been removed from the bonus reel 40 in step S13 and the bonus reel is empty except for the "win all" indicia 44, as illustrated in FIG. 3(*a*)), then the player must place another bet to continue.

Presume that in the next spin the player received the combination of three stars on the main game reels 22, and that this combination entitled the player to a winning of 10 credits, as illustrated in FIG. 3(*b*). The player is paid this amount and then the value "10" is associated with one of the locations or positions on the bonus reel 40. Next, the player is entitled to spin the bonus reel 40. The player elects not to, but instead elects to continue to play the main game. Presume the player plays the game until he has received additional wins from the main game of 20 and 50 credits and these values have also been associated with the bonus reel 40, as illustrated in FIG. 3(*c*). Next assume that the player wishes to spin the bonus reel 40. At this time, the player has the opportunity of receiving no win, a win of 10, 20 or 50 credits, or a "win all," which comprises the total of all the values on the reel 40—in this case 10+20+50=80. Based on the outcome of the spin, as illustrated in FIG. 3(*d*), the player received a bonus win of 50 credits. The player is either not declared a winner or is a winner and paid the winning amount. As illustrated in FIG. 3(*d*), the player received a bonus win of 50 credits.

In one or more embodiments, when all of the positions on the bonus reel 40 are full, then no other amounts are associated with the reel (i.e. lower amounts are not replaced with higher amounts). In another embodiment, when all of the positions on the bonus reel 40 are full, then future winning amounts from the first game are used to randomly replace indicia already associated with the bonus reel 40.

Several aspects of the game of the present invention will now be appreciated. First, the invention is a game which has two primary components, a first main game or event and an additional, separate bonus event. Unlike prior games, however, in accordance with the invention, a player is automatically permitted to participate in the bonus event, but the events are linked in a preferred embodiment in that by receiving one or more winning combinations of the main game, the payout values or other status of the bonus game are changed.

As will be appreciated, if the player elects to spin the bonus reel 40 when no indicia 42 are associated with the reel 40, then player has no chance of winning the bonus event. Likewise, if the player elects to spin the bonus reel 40 when only a single indicia 42 or few indicia besides the win all indicia 44 is associated with the reel 40, then the player has only a low probability of winning the bonus game. In an example where the odds are true and the reel 40 has twelve locations, in the above-example the player's odds of winning would be two in twelve. As one aspect of the game of the invention, a player is enticed to play the main game a long period of time in an attempt to win it as many times as necessary to completely fill the bonus reel 40. Once the player has filled the bonus reel 40, then the player is assured that a spin of that reel 40 will result in a win of some amount.

Moreover, a player is enticed to play the main game in an attempt to not only fill the bonus reel 40, but to fill it with high winning amounts or payouts. As described above, once the bonus reel 40 is full, if the player continues to play the main game and obtains winning payouts, those payouts are compared to the values already on the bonus reel 40. If the later won amounts from the main game exceed the previous amounts, they are replaced. Thus, the player has the opportunity to play the main game to fill the bonus reel 40 with high winning values. Then, when the player plays the bonus event, that player has the opportunity to win much higher amounts.

As another aspect of the invention, a player may play the bonus event at any time, regardless of a winning outcome of the main game or the number of wins achieved by playing the main game. Thus, if a player does not have sufficient time to play the main game to fill the bonus reel 40, the player may still at any time attempt to win the bonus event by spinning the reel 40. For example, a player may play the main game a short period of time before a table becomes available at a restaurant. When the player's table becomes available, the player need not simply leave his efforts, but can spin the bonus reel 40 and attempt to win whatever amounts the player had been able to place thereon by playing the main game.

In one or more embodiments, a player may be permitted to save a game state associated with the gaming apparatus 20. The player may play the game for some period of time, for example filling several of the spots on the bonus reel 40. The player may not desire to play the bonus game at that time, but may not have time to continue playing the main game in an attempt to fill the bonus reel 40. In a preferred embodiment, the player may be provided with a media having game state information associated therewith. As in the case of the player card 100 described above, the game state information may actually comprise game state data, or may comprise information for identifying game state information stored elsewhere, such as on a gaming apparatus or central computer. The stored game state information comprises that information which, when the player re-identifies themselves, such as with a card or code, the gaming apparatus 20 configures itself to the state of the game when the player previously quit playing.

In one embodiment, a player may be provided with a personal "treasure chest" of won indicia which the player may save and utilize when playing future games. As an example, a player may the main game three times and have three indicia associated with the bonus event. In a preferred embodiment, the player is permitted to take those indicia and use them in a future game. In one embodiment, the player is provided with a player card, file or other means for storing information regarding the indicia. For example, the player may utilize their player tracking card to identify themselves and the indicia may be stored (in the form of data) on the card (such as on a magnetic stripe or chip). Alternatively, the data may be stored at a file at a remote server or other location.

As in the example provided above, when a player has won three bonus game indicia, if that player does not at that particular time wish to play the bonus game and use the indicia, the player may be provided an opportunity to save the indicia. When playing a particular game or when beginning play of a game, the player may elect to use those saved indicia. Those saved indicia may be associated with the bonus event of a new game which the player is playing. In one embodiment, a player may select one or all of the stored indicia for use in a later game. In one embodiment, all unused bonus indicia may be automatically stored at the end of a game session.

This embodiment of the invention provides many benefits to a player, including the opportunity to gain the benefits of all bonus indicia won, regardless of whether the player has the present opportunity to participate in the bonus event or obtain all of the bonus indicia necessary for a win. For example, in one embodiment, a bonus win may be awarded if a player receives all of the bonus indicia (such as by filling a bonus wheel or board). One or more of the indicia may be more difficult to win than others when playing the main game. In accordance with this embodiment of the invention, a player who has won one or more of those difficult to obtain bonus indicia but who has not yet won all of the indicia necessary for a bonus win can store those valuable indicia already won for use in the future. In a later game, a player may find they need only one particular indicia to win the bonus event. If the player has won and stored that indicia, it may be associated with the bonus event to complete the win.

In one embodiment, the bonus indicia may have an expiration. In one embodiment, a saved bonus indicia can only be used for a particular period of time before it is lost. This embodiment has the advantage to the game operator that it forces the player to continue playing the game within some period of time in order to gain the benefits of the already won bonus indicia. In one embodiment, the game operator may provide the player with a card having an expiration date, after which use of the card is not permitted (and thus use of the stored bonus indicia data is not permitted). In another embodiment, a particular expiration date may be associated with all or each indicia (such as a particular time from when the indicia is won), and that date may be indicated to the player. In the case of a file containing bonus indicia data of a particular player, the bonus indicia data may be erased once the time frame has passed, or the bonus indicia may be indicated as inaccessible to a player beyond the indicated date and then erased. It will be appreciated that there are numerous manners by which the useful life of a bonus indicia may be indicated to a player and be permitted to be used or not used.

In one or more embodiments of the invention, the indicia which are associated with the bonus game (or vice versa, as detailed below) may comprise other than payout values. Such indicia may have a value associated therewith, or may define a winning outcome only if received at certain times or in certain combinations.

This and other aspects of the present invention will be described with reference to FIG. 4. This embodiment device 120 is similar to the device 20 described above, the device 120 again including multiple main game reels 122. The main game reels 122 are arranged to display one or more indicia 124. A pay line 125 is provided for determining which displayed indicia 124 comprise the outcome of the spin. A bonus reel is provided in the form of a bonus wheel 140. The wheel 140 is capable of displaying a plurality of indicia 142, including a "win all" indicia 144. A marker 148 is provided for determining which portion of the wheel 140 comprises the outcome of a spin of the wheel 140.

In one embodiment of the invention, the device 120 includes a display 150 for displaying one or more of the indicia 124 used to play the game. In a preferred embodiment, these indicia 124 comprise symbols representing the twelve astrological signs.

In accordance with one embodiment of a game of the invention using such a device 120, a player is permitted to pick or select a particular indicia 124 which will comprise a "win all" indicia 144 when associated with the bonus wheel 140. In a preferred embodiment, the player selects a particular indicia 124 by pressing an area of the display 150 which is displaying the indicia. Of course, other means may be provided for permitting the player to input their selection. This selected indicia then comprises an indicia which, when placed on the bonus wheel 140, comprises the "win all"

indicia 144 and entitles the player to the win all amount if received as the outcome of the bonus event.

Play of the game proceeds in the same manner as described above, with the player placing a bet and then playing the main game reels 122. In accordance with this embodiment of the invention, in the event a specific combination of indicia 124 is received, the player-selected indicia 124 is moved to the bonus wheel 140 and comprises the "win all" indicia 144. For example, the player-selected indicia 124 may be moved to the bonus wheel 140 in the event all of the main game reels 122 display the indicia 124. Of course, other of the indicia 124 may be moved to the bonus wheel 140 based on the outcome of the main game as well. In the event the player-selected indicia 124 is moved to the bonus wheel 140, however, that indicia becomes the "win all" indicia 142. If the player obtains the right to spin the bonus wheel 140 and it hits this selected "win all" indicia 144, then the player is entitled to a win all payout.

For example, a player may select the indicia 124 representing the astrological sign "Libra." In the event the player obtains a result of a spin of the main game reels 122 comprising at least a pair of "Libra" signs, then that indicia may be associated with the bonus wheel 140. Upon a spin of the bonus wheel, if the player hits the "Libra" indicia 144, then the player is paid a win all payout.

In this embodiment it is preferred that the bonus wheel 140 initially not have any indicia 142/144 associated with it, or at least no other "win all" indicia. In another embodiment, the bonus wheel 140 may still include another "win all" indicia.

In one or more embodiments, the bonus wheel 140 may be pre-filled with indicia 142. At the beginning of a game, the player may select a particular indicia 142 which will comprise the "win all" or other special winning event indicia 144. The displayed indicia 142 may be "activated," such as by having amounts associated therewith, based on winning outcomes of the main game. Upon receiving one or more particular outcomes of the main game, the indicia selected by the player may be activated, entitling the player to a "win all" (or other) payout if this indicia comprises the outcome of the bonus event.

In one embodiment, the indicia selected by the player need not comprise a "win all" indicia when moved to the bonus wheel 140. Instead, the indicia may be associated with another special or different winning or payout if received by the player. For example, a player may receive a payout of 100 coins for receiving three of the selected indicia on the main game reels 122. Then, for receiving the selected indicia upon spinning the bonus wheel 140, the player may receive 500 coins.

Of course, as with the prior embodiments of the invention, in this embodiment the indicia 124 may comprise a wide variety of symbols, words or the like. Further, this embodiment of the invention may be implemented on a device 20 such as described above where the bonus event comprises a reel. The game described above in conjunction with the first embodiment may alternatively be presented as including a wheel as illustrated in FIG. 4, instead of a reel.

In one embodiment, the wheel 140 may comprise a mechanical element which is rotatable. In another embodiment, the wheel 140 comprises a displayed element. Upon a spin event, appropriate graphics may be used to simulate a rotating wheel 140. The marker 148, which may be a physical element or may be a displayed element, is useful in showing which portion of the wheel 140 comprises the outcome of the spin. In another embodiment, the wheel 140 may be displayed stationary and the portions thereof highlighted or otherwise indicated as selected in a sequential fashion, as if the wheel 140 were rotating. The outcome of the spin may be determined by stopping the moving "highlighting" effect on a single portion of the wheel 140.

In one or more embodiments of the invention, a "win all" indicia 44,144 may be displayed only after a player has filled all of the other locations of the reel 40/wheel 140 with indicia 42,142. For example, with reference to FIG. 4 where the bonus reel 140 includes eight (8) positions, a win all indicia 144 and the associated aggregate award may be automatically displayed when the player fills each of the other seven (7) spaces on the wheel 140 with an associated indicia 142/amount by play of the main game reels 122.

In one or more embodiments, after a player has received a predetermined winning combination on the main game reels 22,122, the one or more indicia comprising that winning combination may be removed from the main game reels 22,122 until a new game is initiated. In this embodiment, the payout associated with a particular combination may be increased, and so may be the amount associated with the bonus reel 40,140 which may be won by spinning the bonus reel.

Various other embodiments of the invention will be described with reference to FIG. 5. In this embodiment, a device 220 is provided which is similar to the devices 20,120 described above, the device 220 again including multiple main game reels 222. The main game reels 222 are arranged to display one or more indicia 224. A pay line 225 is provided for determining which displayed indicia 224 comprise the outcome of the spin. A bonus reel is provided in the form of a bonus board 240.

In a preferred embodiment, the board 240 is capable of displaying a plurality of indicia 242. In one embodiment, the board 240 comprises a video display capable of displaying indicia 242 in a grid-type format, the grid defining spaces or locations for the display of indicia. In a preferred embodiment, indicia 224 from the main game reels 222 are associated with the bonus board 242 when predetermined criteria are met. For example, upon receiving a predetermined winning combination, one or more of the indicia 224 may be associated with the board 240.

In accordance with one embodiment of the invention, a player is the winner of a bonus event if the player receives one of one or more particular arrangements of indicia 242 on the board 240. For example, in the illustrated embodiment, in the event a player receives six of a particular indicia 242 along a row, column or a diagonal, then that player may be declared the winner of the bonus event. The player may be paid winnings based on a predetermined payout schedule. The player may also be paid winnings based on the aggregate value of the winning indicia 242, where the values of the indicia 242 are associated with the board from the main game.

In one embodiment, the spaces or locations of the board 240 may initially be empty or void, and then the indicia 242 displayed therein. In another embodiment, each space or location of the board 240 may be filled in, as with a black cover, and the cover "removed" to reveal the indicia 242. Those of skill in the art will appreciate the numerous ways by which the indicia 242 may be associated with the board 240 for use in the bonus event of the game.

In one embodiment of the game, the bonus board 240 is initially randomly and completely filled with indicia 242. When a player wins the main game, an indicia 242 associated with the bonus board 240 may be highlighted or removed. Alternatively, the player may select a particular indicia 242 to highlight or remove. Again, the player may be declared the winner of the bonus event by obtaining a particular arrangement of indicia 242 (or a lack thereof) on the board. For example, the player may be declared the winner by eliminating all indicia 242 from the board 240 and/or by eliminating a particular row, column or diagonal of indicia. The player may be declared a winner for filling the board 240 with indicia 242 or removing all indicia 242 from the board.

Figure 5:
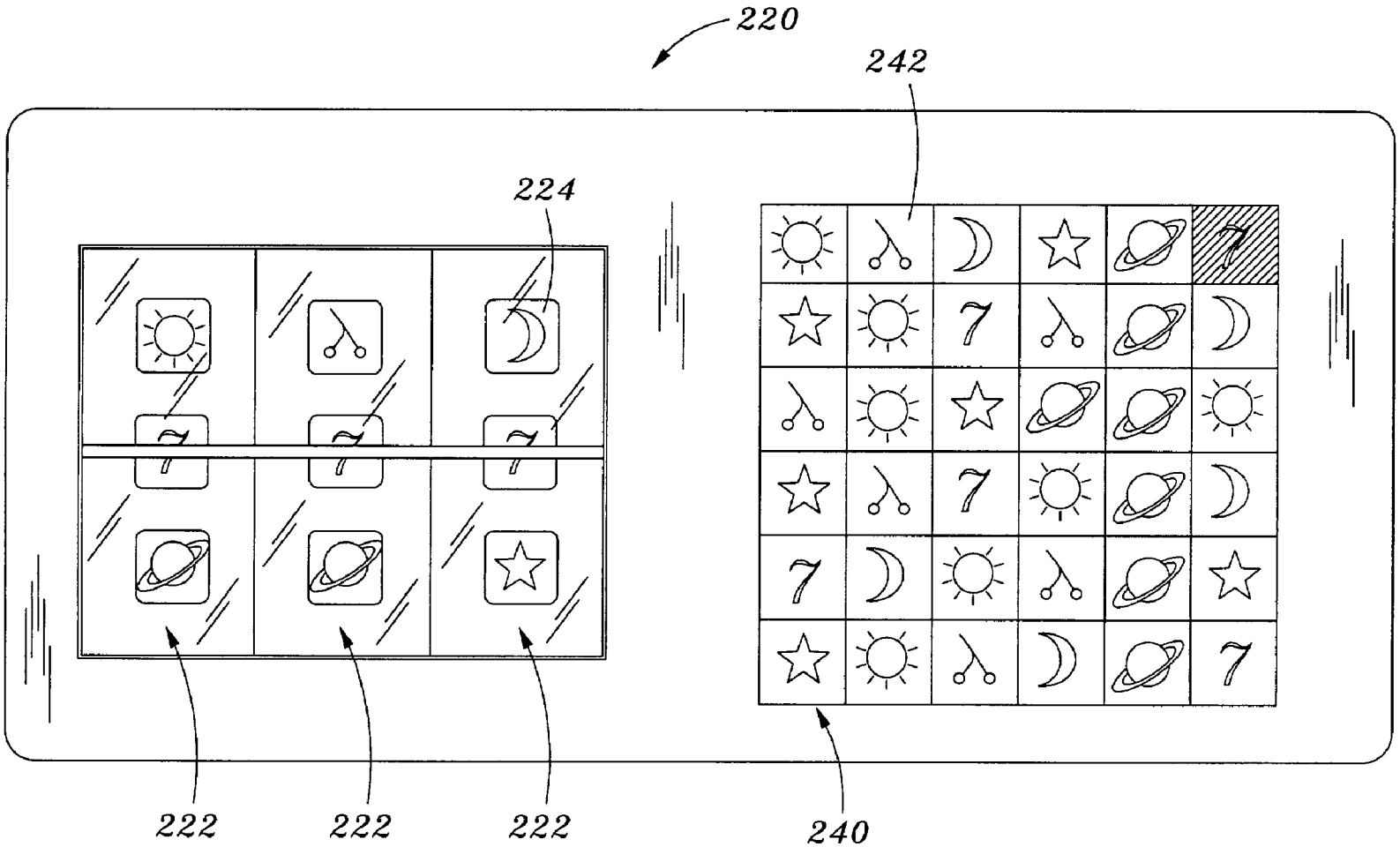
FIG. 5 illustrates yet another gaming device in accordance with an embodiment of the invention.

By way of example to the embodiment illustrated in FIG. 5, the player has received three "7's" on the main game. In one embodiment, this combination may entitle the player to associate a "7" indicia 242 with the bonus board 240. In one embodiment, the player is allowed to select (if more than one "7" indicia is present) a particular "7" indicia associated with the board 240 to highlight. In the illustrated embodiment, the player has selected the "7" indicia 242 in the upper right-hand corner of the board 240.

In one embodiment, one or more of the spaces or locations of the board 240 may be rendered "unplayable" for one or more games, in similar fashion to a crossword puzzle. A player may then attempt to fill the other locations with indicia 242 or remove indicia 242 from the other locations, as the case may be.

As stated above, in one or more embodiments, a player may be entitled to select a location associated with the bonus event or game at which a won indicia may be positioned. This can be particularly advantageous, especially when the bonus game comprises an event requiring that a certain combination of indicia be received in order to achieve a winning outcome. For example, in one embodiment, a particular winning bonus game outcome may be received only if a particular indicia is received on each of three reels (such as indicia representing the front, middle and rear of a car). In such event, it is advantageous to permit the player to associate each of these indicia when won while playing the main game with each appropriate reel so that such a combination is achievable.

As noted above, the bonus event may have a variety of forms. Preferably, however, the outcome of the event is based on random selection from the possible outcomes. In one embodiment, the bonus event includes simulated balloons. As main game play progresses, indicia (such as values) may be associated with the bonus event, as described above. In one embodiment, a plurality of balloons are displayed, and the indicia are associated with the balloons. The balloons may initially be displayed without associated indicia, or may only be displayed once an indicia from the main game is associated with the bonus event. During play of the bonus event, some or all of the balloons may be popped or released. The remaining balloon(s), such as those which are not released or which are not popped, preferably define the outcome of the bonus event.

As an example, after playing the main game a period of time, a plurality of balloons of the bonus event may have indicia associated therewith. Upon playing the bonus game, a plurality of simulated darts may be projected at the group of bonus event balloons. The outcome of the bonus event may be determined by the indicia associated with the balloon or balloons which are not popped by the darts.

In another embodiment, the bonus event may include the display of a simulated tower. As play of the main game progresses, portions of the tower may be illuminate or indicia associated therewith. In the event the player fills all sections of the tower (such as by illuminating all portions of the tower), the player may be declared the winner of the bonus event. In another embodiment, a simulated gorilla may climb the tower as part of the bonus event, and the outcome of the bonus event may be determined by the indicia associated with a particular portion of the tower where the gorilla stops climbing.

In another embodiment, the bonus event may include the display of a sphere or an arrangement of indicia from or associated with the main game in a form of a sphere. For example, a sphere may be displayed and indicia from the main game be associated with locations on or in the sphere. Such an arrangement provides a large and varied number of indicia locations.

In one or more embodiments, a plurality of players may participate in a common game. In one embodiment, a plurality of main games are linked to one or more common bonus games. One such bonus game may comprise a bonus game board having a plurality of spaces. When an indicia is obtained by play of a main game, that indicia may be posted on the common bonus board. A player may obtain an indicia playing the main game which is posted to the bonus game board and result in a winning event when considering the other bonus indicia already associated with the bonus game, some or all of which may have been posted by players of other main games. In this arrangement, a player is permitted to utilize the bonus indicia won by other players.

A variety of arrangements of this aspect of the invention may be provided. For example, in one embodiment, when a particular event occurs with respect to the bonus game, then all players who played the main game and contributed to the event may participate in a bonus event. For example, in one embodiment, a bonus wheel may be provided which may be spun when all of the spaces thereon are filled with indicia. In this embodiment, each player who has one a main game and posted an indicia on the bonus wheel may be permitted to participate in the bonus event (such as by spinning a bonus wheel) once the bonus wheel is filled.

In one or more embodiments of the invention, indicia may be associated with the main game from the bonus game or event. For example, in one embodiment, a game board of bonus indicia is provided which is initially filled with bonus indicia at the beginning of the game. As a result of main game play, the player may be entitled to play the bonus game. In one embodiment, if a player receives a particular outcome playing the main game, the player is entitled to engage in the bonus game. In this embodiment, squares or areas of the bonus game board may be illuminated. If an area corresponding to a bonus indicia is illuminated, that bonus indicia may be "won" and associated with the main game. In one embodiment, the bonus indicia may be displayed in an open position of a reel or replace an indicia already associated with the main game. In one embodiment, one or more outcomes of the main game are thus varied based upon the association of the bonus indicia with the main game. For example, a player may attempt to associate the three parts of a car (indicia representing the front, middle and rear of the car) from the bonus board with the three reels of the main game. If, once having associated those bonus indicia with the main game the player receives the outcome of the main game comprising these three car indicia, then the player may win a car or other prize.

Figure 6:
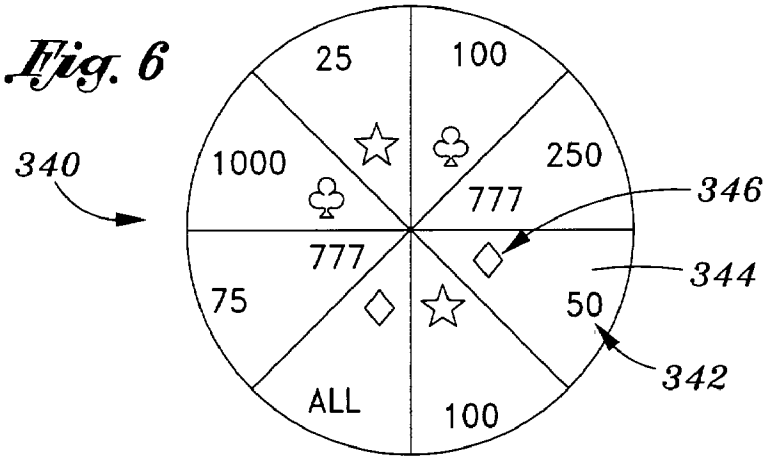
FIG. 6 illustrates yet another embodiment of a bonus event in accordance with the invention.

FIG. 6 illustrates yet another embodiment of a bonus event or game in accordance with the invention. This figure illustrates a bonus display 340 having a plurality of areas 344. At least one indicia 346 is associated with each area 344. In addition, a particular bonus amount 342 is associated with each area 344.

In accordance with this embodiment of the invention, receipt of an indicia as a result of playing the main game activates one or more areas 344 of the bonus event 340.

Preferably, each area 344 having a main indicia which matches the received indicia while playing the main game is activated. For example, as illustrated in FIG. 6, a player may receive the winning outcome of a main game of three rotating reels comprising 7-7-7. In such event, the corresponding areas 344 of the bonus device 340 may be activated.

By the term "activated" it is meant that the particular area 344, and thus its associated bonus amount, is eligible for selection during play of the bonus event. For example, as described below, in the case of a bonus wheel or display 340 as illustrated, an activated area 344 may be selected. Selection of the area 344 results in an award to the player.

In one embodiment, a "all" or "win all" indicia may be associated with one or more of the areas 344. In one embodiment, this area 344 is always activated.

In one embodiment, each area 344 defines a potential winning or award 342. For example, if the "diamonds" area is activated and the bonus event outcome is the selection of that area 344, then the player may be awarded 50, such as 50 coins or credits. The award which is associated with a particular area may be displayed or may not be displayed. In addition, the award which is associated with a particular area may represent a tangible prize or a monetary award, credits or other elements. In one embodiment, the awards which are associated with particular areas may be pre-assigned, or may be received as a result of play of the main game.

The bonus event may be activated in a number of fashions, as detailed above. For example, the bonus event may comprise a rotating wheel or a video-displayed image. In the case of a rotating wheel, the wheel may be controlled so that it may only stop at an activated area. In other words, the wheel is prevented from stopping at positions or areas which are non-activated. Such control may be effected by a stepper motor or the like.

In one embodiment, a visual indication of the activation of an area 344 may be provided. This indication may comprise illumination of the area or the like.

In one embodiment, the bonus event may comprise a larger or smaller number of areas other than those illustrated in FIG. 6. The areas may be associated with a greater or lesser number of indicia, the indicia being the same or different and being of a larger or smaller number than illustrated.

In one embodiment, upon receiving a particular main game outcome, all corresponding areas of the bonus event are activated. In another embodiment, only a single area is activated and other areas must be activated independently.

This embodiment of the invention has applicability to other bonus events. For example, the bonus event may comprise a bonus board having a number of areas or positions. An indicia may be associated with each area, or a group of areas (such as a row or column). Areas may be again activated based upon outcomes of the main game. Play of the bonus event may comprise the random selection of an activated area from within the grid or board of areas.

In one embodiment, play of the bonus event may comprise the selection of an area, whether activated or not. If the area was not activated, it may not result in a win. In this manner, a player is enticed to continue to play the main game until a great number, if not all, of the bonus event areas are activated. Once play of the bonus event has occurred, the areas are preferably deactivated.

As described above, the invention may be applied to a wide variety of main games, such as card games, and the indicia utilized to play the bonus event may comprise a wide variety of indicia, such as cards.

Figure 7:
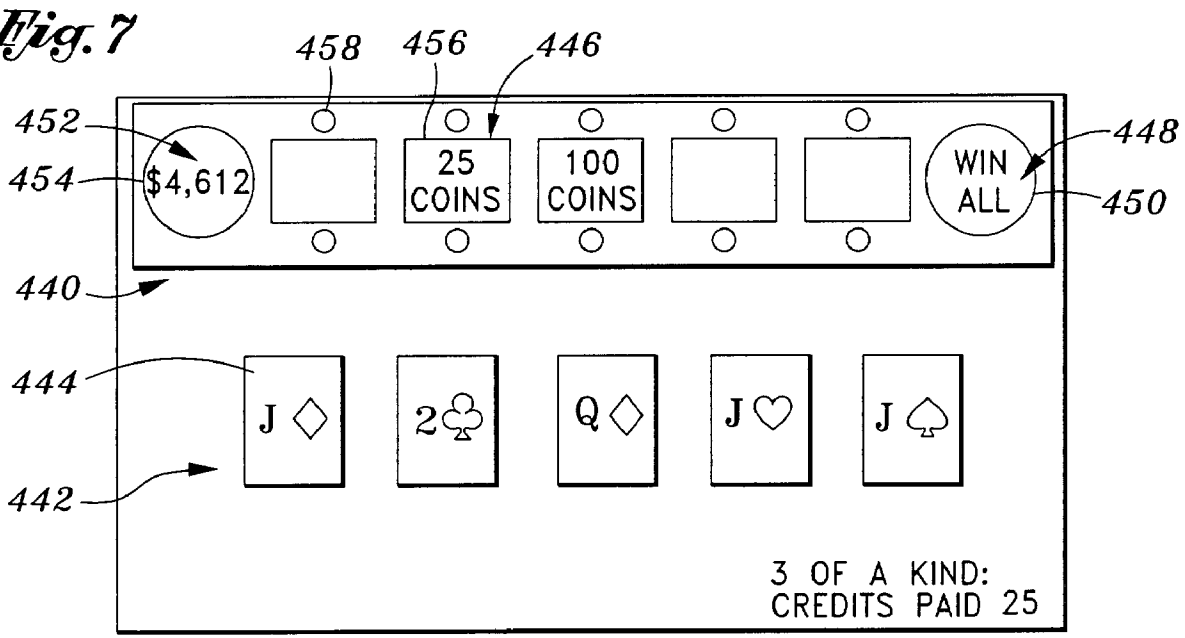
FIG. 7 illustrates a display of a gaming device configured to present yet another embodiment main game and bonus event in accordance with the invention.
Figure 8:
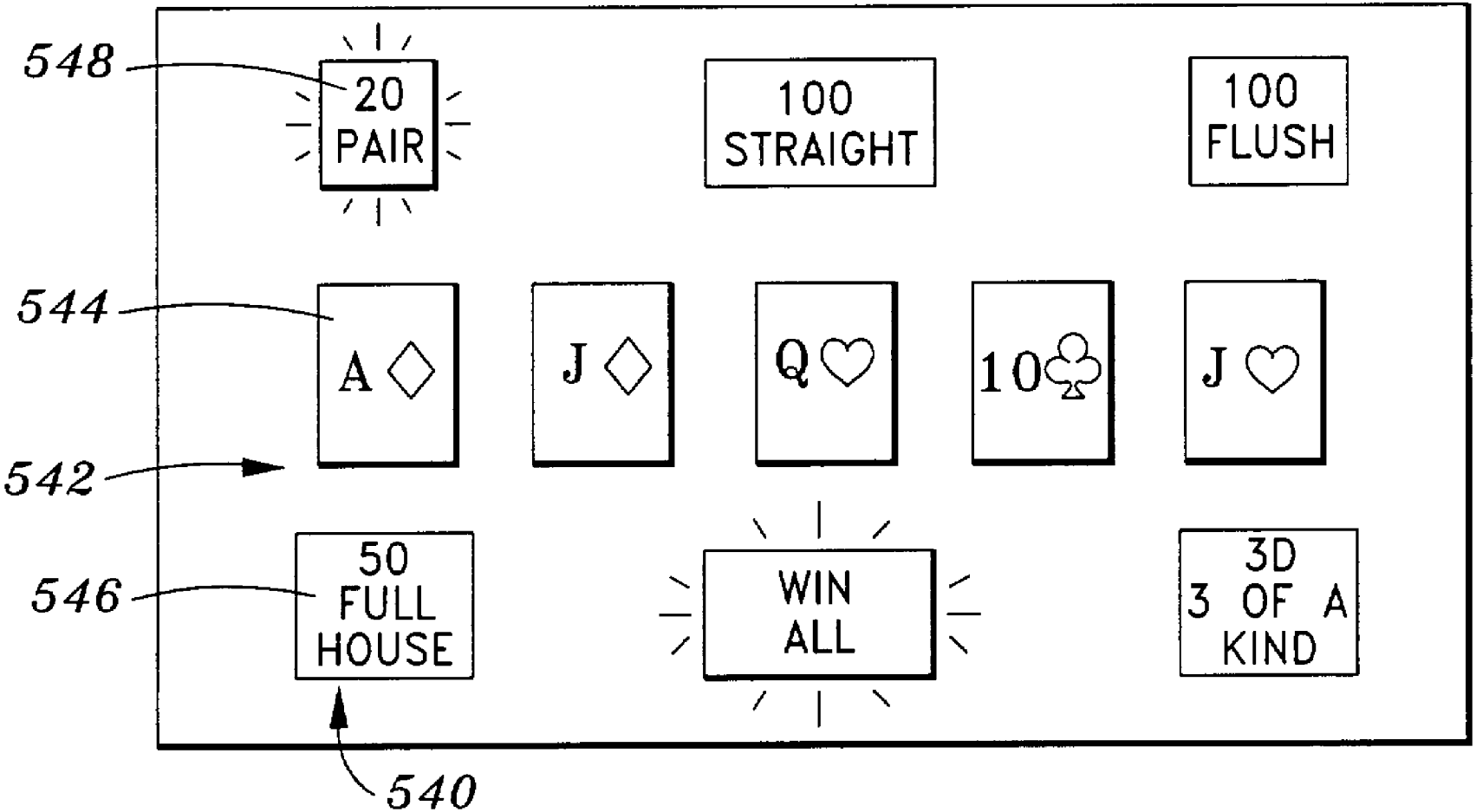
FIG. 8 illustrates another display of a gaming device configured to present yet another embodiment main game and bonus event in accordance with the invention.

FIGS. 7 and 8 illustrate other embodiments of the invention. Referring to FIG. 7, a main game comprises a video poker game in which a hand 442 of five cards 444 are displayed. As is known the art of video poker, the outcome of the game is determined by comparing the hand 442 of cards to predetermined winning combinations of cards. In various embodiments, a hand of cards, such as a 5 or 7 cards, is dealt. A player may elect to hold or discard and replace one or more of the cards to form a final hand. If the outcome is a winning outcome, the player is awarded cash or credits. Of course, a variety of main games may be played with cards, including a variety of poker games, Blackjack and others.

In accordance with the invention, there is a bonus event. As illustrated, the bonus event includes a bonus display 440. The display 440 includes a plurality of winning positions 446 which may be filled. Preferably, a progressive win 454 and win all 450 position are provided as well. As detailed below, the progressive win 454 area displays a progressive win amount 452, while the win all 450 area displays a win all indication.

In accordance with the play of the game, in similar manner to the game described above and illustrated in FIGS. 3A–3D, a player plays the main game. In the event a particular outcome is received while playing the main game, either an indicia is posted to the bonus display 440 or an area or category of the bonus event or game is activated.

For example, as illustrated in FIG. 7,an indicia may be posted to the bonus display 440, the indica comprising the value or amount of win received while playing the main game. For example, as illustrated, if the player received a winning 3 of a Kind hand while playing the main game and was awarded 25 credits, then the indicia "25" credits 446 is posted to one of the positions 456 of the bonus display 440. Of course, a representation of the amount won may also be displayed, rather than the actual amount won. For example, the indicia "3 of a Kind" might be displayed, it being known that this indicia represents 25 credits.

In one embodiment, the bonus display 440 includes a plurality of positions 456 to be filled, in like manner to the embodiments described above. A player is preferably permitted to play the bonus event at any time, including before all of the positions 456 are filled.

In one embodiment, the player is enticed to fill all of the positions 456. As illustrated, the bonus display 440 includes a "win all" indicia 448 displayed in a "win all" position 450. As detailed below, if the player hits the "win all" position 450 while playing the bonus event, the player is entitled to an award of the total of all amounts displayed by the bonus display 440. The more amounts which the player has posted to the bonus display areas 456, the more the player may thus win. As detailed above, a player may also be permitted to replace lower amounts with higher mounts as they are won while playing the main game.

In accordance with one embodiment of the invention, the bonus event includes a progressive win amount. In one embodiment, when a player places a wager or bet to play the main game, a portion of the wager or bet is assigned to a progressive pool. In another embodiment, an added bet may be required to participate in the progressive pool portion of the bonus event. For example, an extra coin wager over the maximum coin wager on the base game may be required to activate this feature (e.g. five coin or credit maximum base game bet plus an additional coin or credit bet for the progressive pool activation). In such event, the "extra" wager may be used to fund the progressive pool. The pool continues to grow in size until a player playing the bonus event receives the progressive pool or a portion of the pool. Of course, the progressive amount may be funded in a variety of other manners. Additional details of such a progressive are provided above.

As illustrated in FIG. 7, the current progressive pool amount 452 is displayed in a progressive area 454. If the bonus event outcome results in the selection of that area 454, then the player is awarded the progressive pool amount. In another embodiment, the player is also entitled to win the progressive pool amount if the outcome of the bonus event is "win all."

In one embodiment, gaming machines at which the game is presented may be linked. The a single progressive pool may be assigned to the linked machines, permitting the size of the progressive pool to increase more rapidly. Each player of any linked gaming machine is entitled to win the progressive pool amount.

In one embodiment, the progressive pool may be funded to a minimum amount. For example, the progressive pool may be funded with no less than $1000.00. In such event, if the progressive pool amount is won, the pool amount automatically resets back to $1000.00, and not to $0.00.

The bonus event may be activated in a variety of manners, as detailed above. For example, a player may be permitted to play the bonus event at any time by activating a "bonus" button or the like.

In one embodiment, play of the bonus event comprises the random selection of one of the bonus areas 456, including the "win all" area 450 and progressive area 454, as well as other areas, if so provided. Indication of the selection of a particular area may be provided by illumination. In one embodiment, two lights 458 are associated with each posting area 456, while the win all and progressive areas 450,454 are lighted. When the bonus event is activated, the lights or lighted areas may illuminate in random or in sequence, with the outcome determined by the last illuminated position. Other means may be provided for operating the bonus event, as described above.

Another embodiment of the invention will be described with reference to FIG. 8. FIG. 8 illustrates a version of the invention similar to that illustrated in FIG. 6, where areas of the bonus event are "activated."

As illustrated in FIG. 8, a main game comprises a video poker game in which a hand 542 comprises a set of cards 544. The bonus event comprises a display 540 of a plurality of predetermined categories 546. A player attempts to obtain a winning outcome while playing the main game which corresponds to one of the bonus event categories. If so, then that particular bonus event category is activated. When activated, the bonus category may be illuminated 548. Other means may be provided for indicating to a player that an area or category is activated.

In one embodiment, each category is associated with or defines a particular bonus event award. Play of the bonus event preferably comprises the random selection of one of the activated categories. The player is awarded the bonus event amount associated with the selected category.

As in the previous embodiments, a plurality of variations of the game are contemplated. For example, as described above, a "win all" category may be provided which is always activated. A player may be permitted to play the bonus event at any time or only at a specific time (such as upon activation of all categories). The bonus display 540 may have a variety of forms, including the form of a wheel or as a bonus board of a grid of areas.

It will be understood that the above described arrangements of apparatus and the method therefrom are merely illustrative of applications of the principles of this invention and many other embodiments and modifications may be made without departing from the spirit and scope of the invention as defined in the claims.

What is claimed is:

1. A method of playing a game comprising the steps of:

accepting a wager;

presenting a main game including the step of displaying at least a first set of cards to generate a main game hand;

determining the outcome of said main game comprising comparing said main game hand to a set of predetermined winning hands;

if said main game hand is a predetermined winning hand, awarding said player a winning amount and additionally displaying an indicia representing said winning amount; and playing a bonus event using said displayed indicia and awarding said player said winning amount represented by said displayed indicia.

2. The method in accordance with claim 1 wherein said presenting step comprises displaying a first set of five cards, accepting an election to hold none, one or more of said cards, and replacing each non-held card to create a five card main game hand.

3. The method in accordance with claim 1 wherein said step of displaying an indicia comprises displaying said winning awarded to said player in a bonus area.

4. The method in accordance with claim 1 wherein said step of using said displayed indicia comprises randomly selecting one of said displayed indicia.

5. A method of playing a game comprising the steps of:

accepting a wager;

presenting a main game including the step of displaying at least a first set of cards to generate a main game hand;

determining the outcome of said main game comprising comparing said main game hand to a set of predetermined winning hands;

if said main game hand is a predetermined winning hand, awarding said player a winning amount and activating at least one area of a bonus event having a plurality of areas;

playing said bonus event by randomly selecting at least one of said activated areas of said bonus event; and paying said player a winning amount corresponding to said selected activated area as a result of playing said bonus event.

6. The method in accordance with claim 5 wherein said main game is a game of video poker.

7. The method in accordance with claim 5 wherein each of said areas of said bonus event is associated with at least one winning hand, and wherein said step of activating comprises activating at least one area associated with a winning hand received while playing said main game.

8. A method of playing a game comprising the steps of:

accepting a wager;

presenting a main game using a plurality of indicia;

determining if the outcome of said main game is a winning outcome;

awarding an award if said outcome of said main game is a winning outcome;

providing a bonus event having a plurality of categories, each category associated with one or more possible winning outcomes of said main game;

if said winning outcome of said main game corresponds to one of said categories of said bonus event, activating one or more of said corresponding categories; and playing said bonus event by randomly selecting at least one of said activated categories of said bonus event.

9. The method in accordance with claim 8 wherein said main game is a slot type game in which indicia are randomly displayed and said outcome of said main game is determined by the indicia which are displayed, and wherein said areas of said main game are associated with indicia used to play said main game.

10. The method in accordance with claim 8 wherein said main game is a game of video poker using card indicia and said winning outcomes comprise card hands.

11. The method in accordance with claim 8 wherein said step of activating comprises illuminating said one or more categories.

12. The method in accordance with claim 8 wherein said step of activating comprises posting a winning amount to said category.

13. The method in accordance with claim 12 wherein said winning amount comprises said award awarded as a result of receiving said winning outcome while playing said main game.

14. The method in accordance with claim 8 wherein at least one of said categories of said bonus event is a win all category and said category is activated at all times and wherein if said category is selected in the play of said bonus event a bonus award is awarded which totals the amount of all awards associated with all activated categories.

15. The method in accordance with claim 8 including allocating at least a portion of a wager to a progressive pool and wherein at least one of said categories of said bonus event is a progressive win category and said category is activated at all times and wherein if said category is selected in the play of said bonus event said progressive pool amount is awarded.

* * * * *

UNITED STATES PATENT AND TRADEMARK OFFICE

CERTIFICATE OF CORRECTION

PATENT NO. : 7,011,581 B2
APPLICATION NO. : 10/316698
DATED : March 14, 2006
INVENTOR(S) : Cole et al.

It is certified that error appears in the above-identified patent and that said Letters Patent is hereby corrected as shown below:

On the Title Page Item (63)

Under the Related U.S. Application Data heading, Line 1, please change "No. 09/849,222" to --No. 09/849,333--.

In Column 1, Line 7, please change "No. 09/849,222" to --No. 09/849,333--.

Signed and Sealed this

Twenty-fourth Day of June, 2008

JON W. DUDAS
*Director of the United States Patent and Trademark Office*